US006779684B2

(12) United States Patent
Shin

(10) Patent No.: US 6,779,684 B2
(45) Date of Patent: Aug. 24, 2004

(54) VENDING MACHINE FOR KIMCHI

(75) Inventor: Suk-Ho Shin, Suwon-si (KR)

(73) Assignee: Ace-Mechatronics Co., Ltd., Kyungi-Do (KR)

( * ) Notice: Subject to any disclaimer, the term of this patent is extended or adjusted under 35 U.S.C. 154(b) by 19 days.

(21) Appl. No.: 10/351,945

(22) Filed: Jan. 27, 2003

(65) Prior Publication Data

US 2003/0183645 A1 Oct. 2, 2003

(30) Foreign Application Priority Data

Apr. 1, 2002 (KR) ..... 20-2002-0009692 U

(51) Int. Cl.[7] ..... A24F 27/14

(52) U.S. Cl. ..... 221/150 R; 221/131

(58) Field of Search ..... 221/266, 150 R, 221/131, 194, 133, 129, 124, 191, 123; 312/36, 42; 62/331

(56) References Cited

U.S. PATENT DOCUMENTS 5,570,587 A * 11/1996 Kim ..... 62/331

* cited by examiner

*Primary Examiner*—Kenneth Noland
(74) *Attorney, Agent, or Firm*—Richard M. Goldberg

(57) ABSTRACT

A vending machine for kimchi including a compressor at a lower portion, a low temperature storage part above the compressor and including partitions for holding packed kimchis, a first motor at a bottom of each partition, a transportation plate operated by each motor, a cam linked to each transportation plate via an axis, a first limit switch located to contact the cam, a discharge plate at a bottom of the low temperature storage part, a second limit switch turned on when the discharge plate is opened to discharge a kimchi, a spring at an opposite side of the discharge plate, a second motor at one side of the discharge plate to return the discharge plate to an original position, an evaporator and a fan installed over the low temperature storage part, and a money slot, selection buttons and an outlet equipped in the door.

5 Claims, 6 Drawing Sheets

VENDING MACHINE FOR KIMCHI

BACKGROUND OF THE INVENTION

The present invention relates to a vending machine for kimchi. More particularly, the present invention relates to a vending machine for kimchi comprising a compressor and a low temperature storage part on the compressor in which several kinds of packed kimchis are contained in respective partitions. Said vending machine maintains freshness of various packed kimchis and thus can store various kimchis under the optimum conditions without going bad. Therefore, the vending machine for kimchi of the present invention can easily provide delicious kimchi in accordance with consumer's needs.

Generally, a kimchi has been stored in a general refrigerator or an exclusive refrigerator for kimchi at home. However, a packed kimchi sold at a supermarket or in a market is stored in an exhibition refrigerator together with various other packed foods. It is preferred for kimchi to be stored at a temperature of about 1° C. Whereas, a packed meat such as a sausage is preferred to be stored at a temperature of about 4° C. Therefore, when kimchi and other foods, which have different optimum storage temperatures, are stored in one refrigerator, kimchi cannot be maintained in a fresh state and is goes bad. Even though an exhibition refrigerator for kimchi only is used, it is not suitable for various kimchis which have different optimum storage temperatures, respectively. Each kimchi has a particular maturation temperature depending on a main material such as a cabbage, a radish, a stone-leek, etc. and other additives such as vegetables, fruits, oyster, pickled fishes, etc. Since an exhibition refrigerator is operated under a fixed temperature, various kimchi cannot be stored under the optimum conditions in such refrigerator. Furthermore, since an exhibition refrigerator is frequently opened and contacted with outer air, it is difficult to keep the fixed temperature. After all, this causes kimchi to deteriorate. Thus, it is hard to get delicious taste of kimchis when storing in the exhibition refrigerator. It is furthermore not actually possible for purchasing refrigerators for respective kimchi in order to get delicious taste thereof.

SUMMARY OF THE INVENTION

The present invention was designed to solve the aforementioned problems.

An object of the present invention is to provide a vending machine for kimchi which comprises a compressor at the bottom, a low temperature storage part on the compressor comprising several partitions containing packed kimchis, a first motor at the bottom of each partition, a transportation plate operated by the motor, a cam which is linked to the transportation plate via an axis and contacts a first limit switch at a side, a discharge plate installed at the bottom of the low temperature storage part, a second motor set up under one side of the discharge plate, a spring set up at the other side of the discharge plate, a second limit switch installed to be turned on when the discharge plate is opened, an evaporator and a fan installed over the low temperature storage part, and a money slot, selection buttons and outlet equipped in the door.

If a user inserts a coin or paper money and pushes the selection buttons to choose a kimchi, a first motor at the bottom of the low temperature storage part is started and a transportation plate linked to the motor via an axis is rotated to allow a packed kimchi mounted on the plate to go down a discharge plate. Simultaneously, a cam at one side is rotated to contact a first limit switch and thereby the motor is stopped and the discharge plate is opened due to the weight of a packed kimchi. Thus, the packed kimchi slips down from the opened discharge plate to an outlet. The opened discharge plate contacts a second limit switch and thereby a second motor at one side is operated to make the discharge plate return to the original position.

The vending machine for kimchi of the present invention contains various kimchis at several partitions and maintains the freshness of the kimchis by keeping them under the optimum temperature. Thus, said vending machine can conveniently provide various kimchis having delicious taste in accordance with the needs of a consumer.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

Figure 1:
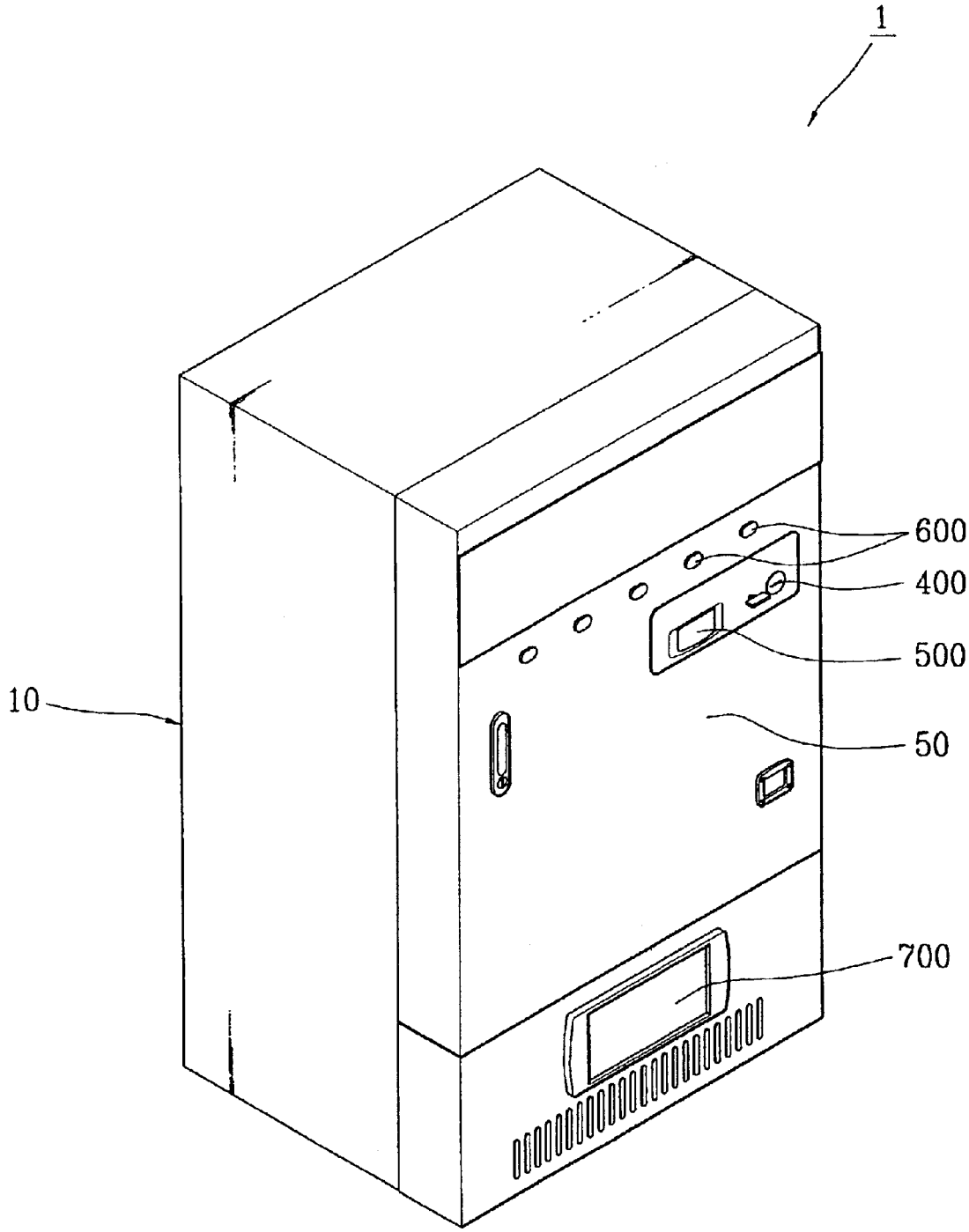
FIG. 1 is a perspective view of a vending machine for kimchi of the present invention.
Figure 2:
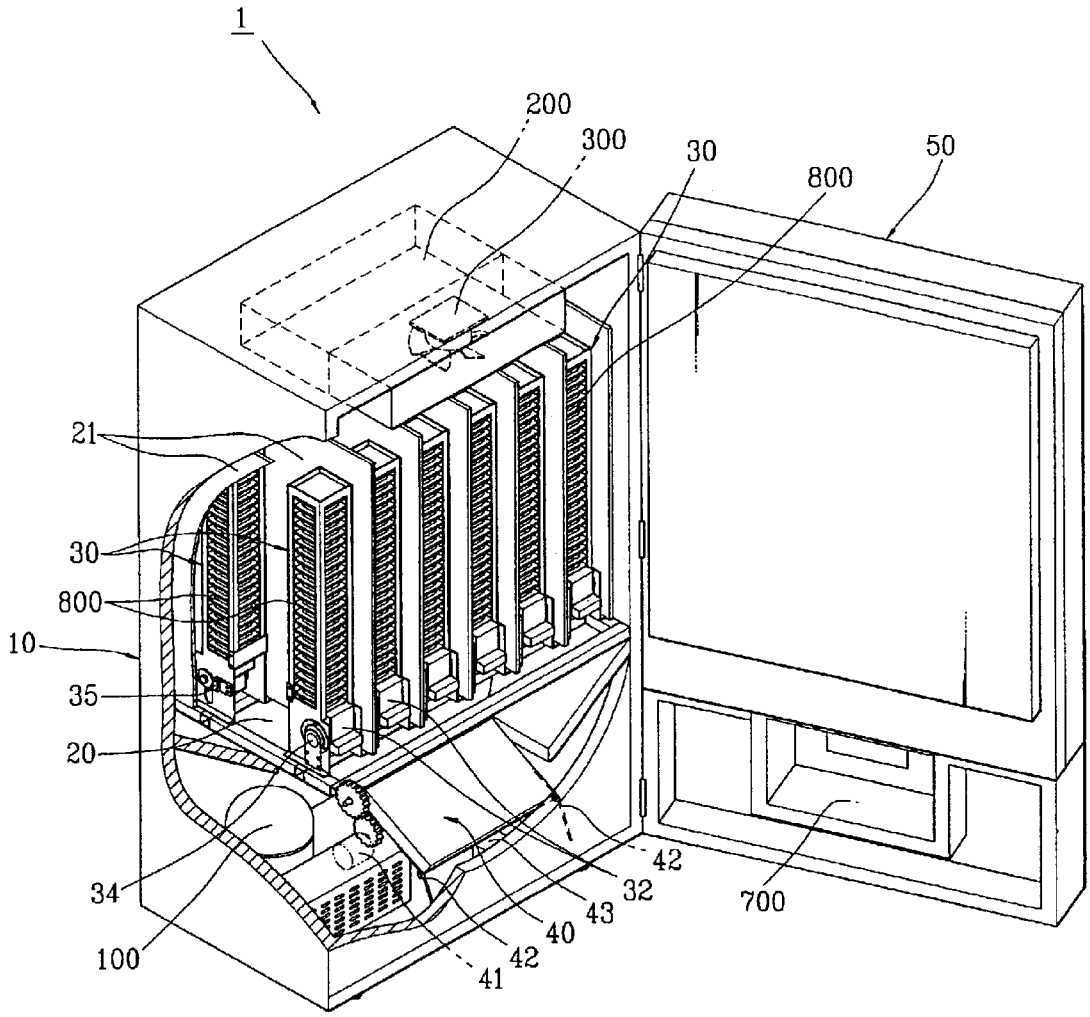
FIG. 2 is an illustrated partial cross-sectional view showing a main portion of a vending machine for kimchi of the present invention having the door opened.
Figure 3:
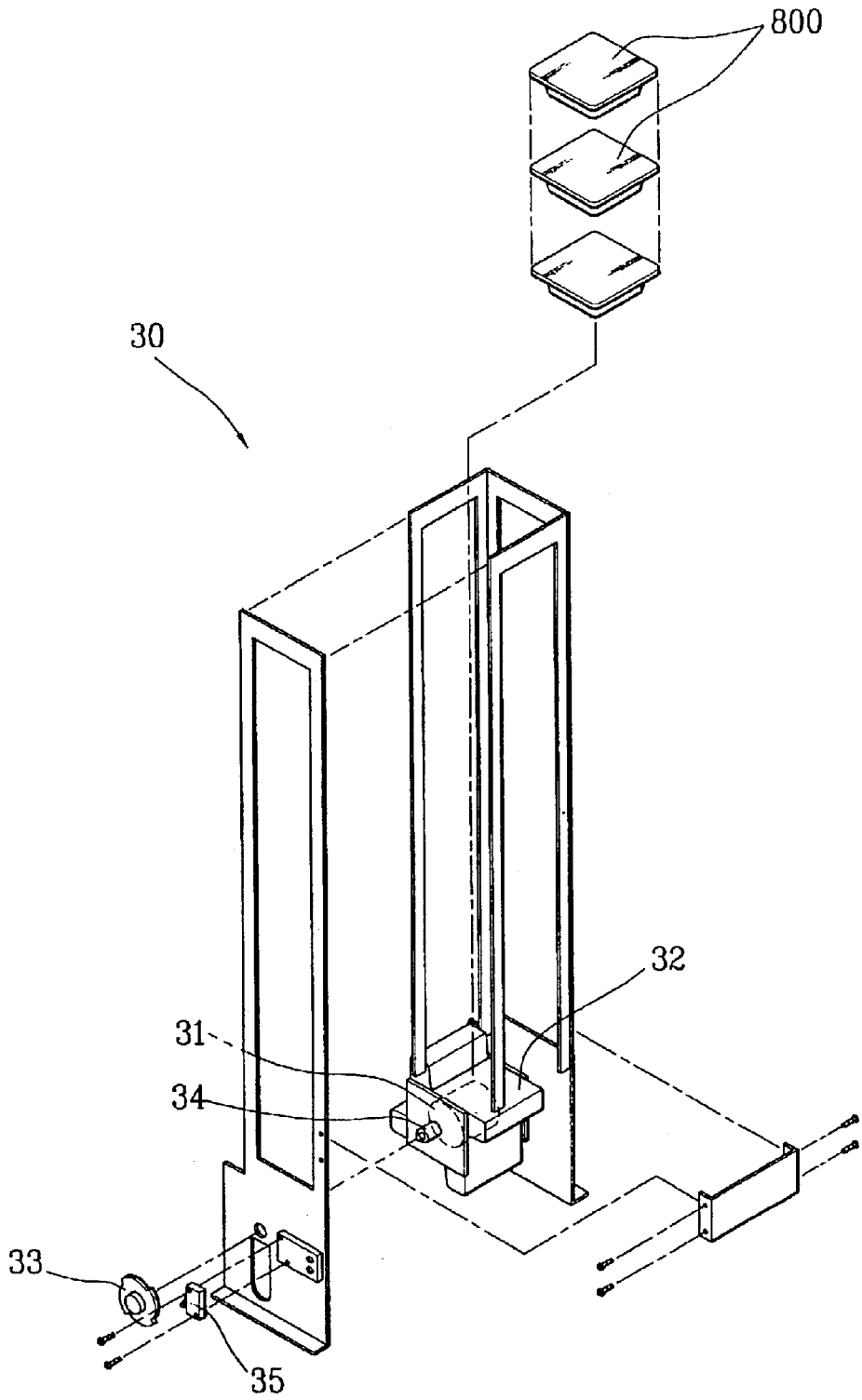
FIG. 3 is an exploded perspective view of a partition of a low temperature storage part of a vending machine for kimchi of the present invention.
Figure 4:
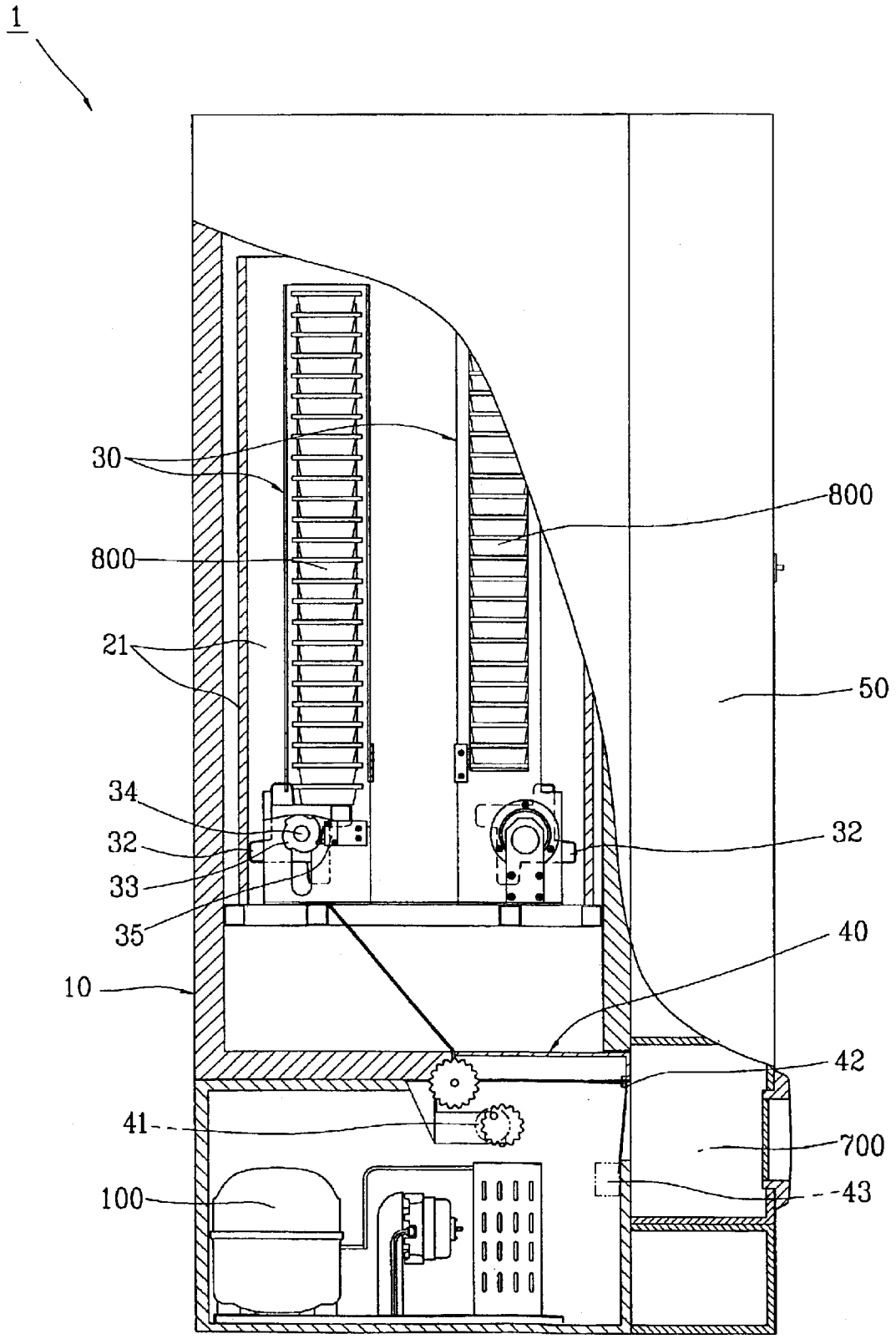
FIG. 4 is an illustrated partial cross-sectional view showing a main portion of a vending machine for kimchi of the present invention.
Figure 5:
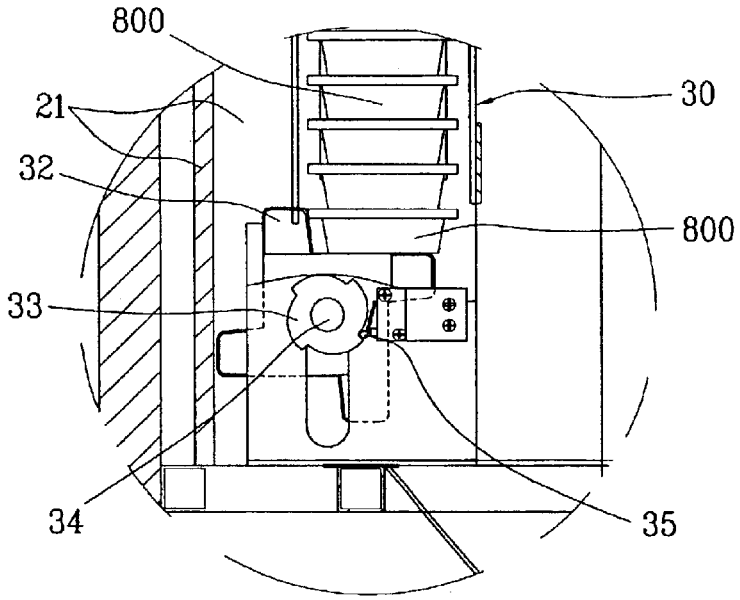
FIG. 5 is an illustrated partial enlarged cross-sectional view showing the bottom of a low temperature storage part of a vending machine for kimchi of the present invention.

The present invention is related to a vending machine for kimchi 1 which comprises a compressor 100 at the bottom, a low temperature storage part 20 above the compressor 100 and comprising several partitions 30 made by walls 21 containing packed kimchis, a first motor 31 at the bottom of each partition 30, a transportation plate 32 operated by each motor 31, a cam 33 which is linked to the transportation plate via an axis 34 and contacts a first limit switch 35 at one side, a discharge plate 40 installed at the bottom of the low temperature storage part 20, a second motor 41 set up under one side of the discharge plate 40, a spring 42 set up at the other side of the discharge plate, a second limit switch 43 installed to be turned on when the discharge plate 40 is opened, an evaporator 200 and a fan 300 installed over the low temperature storage part 20, and slots 400, 500 for coins and paper money, selection buttons 600 and an outlet 700 equipped in the door 50 installed in the front of the main body 10.

Unexplained numeral 800 indicates a packed kimchi.

A vending machine for kimchi 1 of the present invention can include various kimchis having main materials or weights different at several partitions 30 installed in low temperature storage part 20 inside of main body 10, and set to maintain independently optimum temperatures for kimchis at respective partitions. For that purpose, a compressor 100, an evaporator 200 and a fan 300 are programmed to be turned on and off repetitively.

Figure 6:
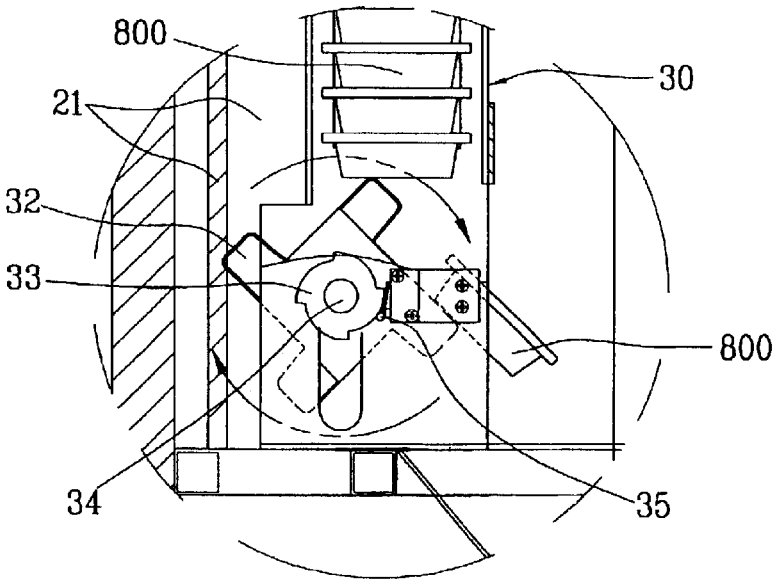
FIG. 6 is an illustrated partial enlarged cross-sectional view showing a state of a transportation plate being operated at the bottom of a low temperature storage part of a vending machine for kimchi of the present invention.
Figure 7:
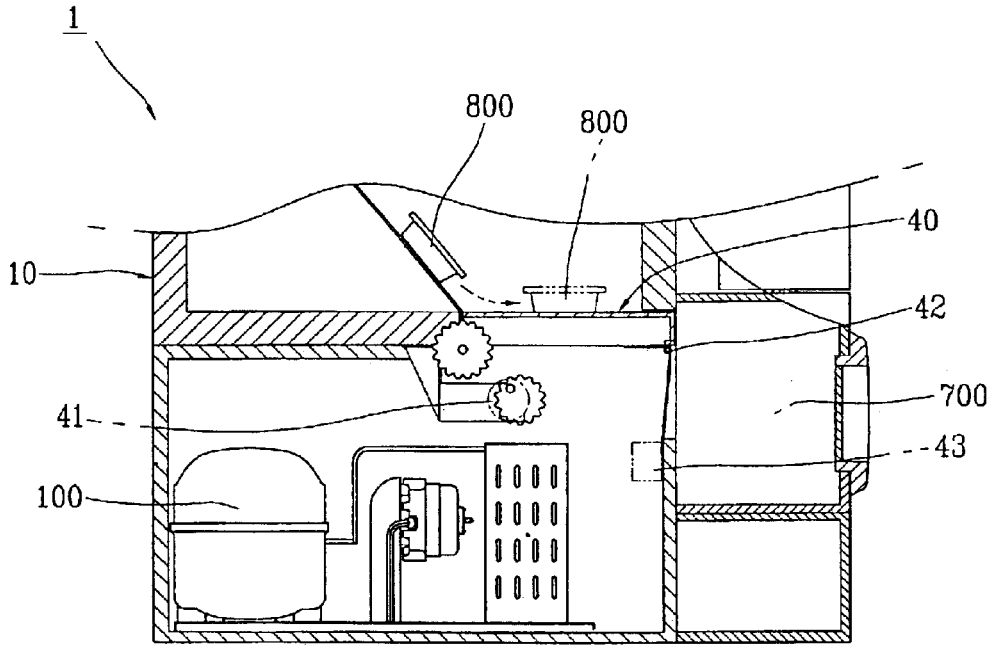
FIG. 7 is an illustrated partial cross-sectional view showing a state of a packed kimchi being positioned on a discharge plate of a vending machine for kimchi of the present invention.
Figure 8:
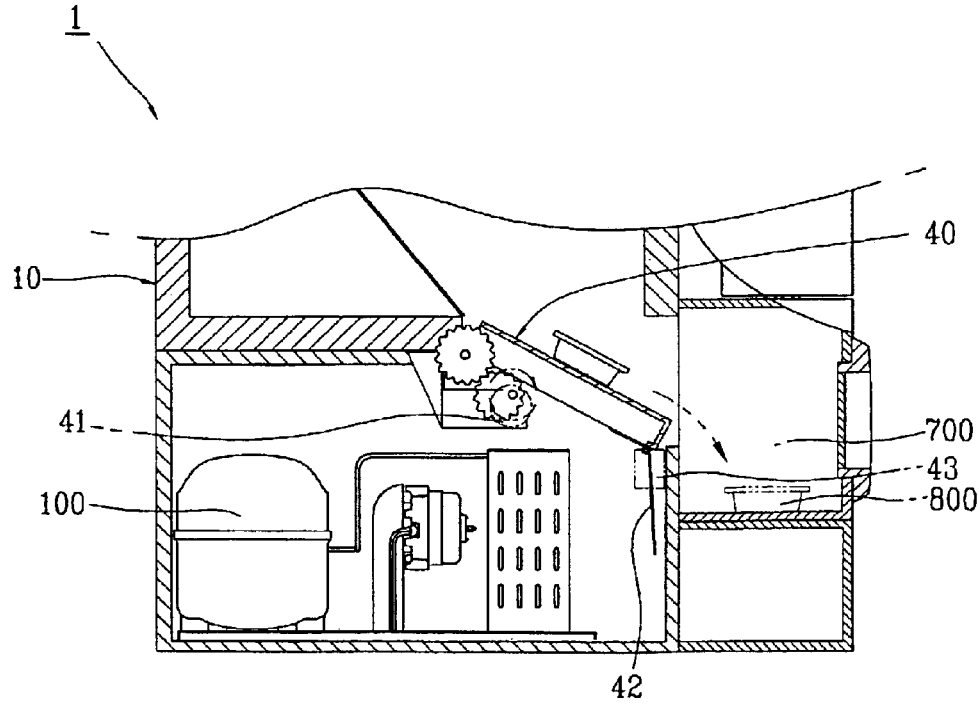
FIG. 8 is an illustrated partial cross-sectional view showing a state of a packed kimchi being completely slipped down from a discharge plate of a vending machine for kimchi of the present invention.

If a user inserts a coin or paper money into the slots 400, 500 and pushes the selection buttons 600 to choose a kimchi, a first motor 31 at the bottom of low temperature storage part 20 is started and a transportation plate 32 linked to the motor via an axis 34 is rotated to allow a packed kimchi 800 mounted on the plate to go down discharge plate 40, as shown in FIG. 6. Simultaneously, a cam 33 at one side is rotated and contacts first limit switch 35, and thereby the motor 31 is stopped and the discharge plate 40 is opened due to the weight of a packed kimchi 800. Thus, the packed kimchi 800 slips down from the opened discharge plate 40 to an outlet 700. The opened discharge plate 40 contacts a second limit switch 43, as shown in FIG. 8, and thereby a second motor 41 at one side is operated to return the discharge plate 40 to the original position.

As mentioned above, the vending machine for kimchi of the present invention provides various packed kimchis having different materials and weights 800 dispensed to the discharge plate from the low temperature storage part by a consumer pushing selection buttons 600.

As described above, the vending machine for kimchi 1 of the present invention contains various packed kimchis 800 at several partitions 30 and maintains the freshness of the kimchis 800 by keeping them under the optimum temperature. Thus, said vending machine can conveniently provide various kimchis having delicious taste and store them without causing deterioration.

What is claimed is:

1. A vending machine for kimchi comprising:

a main body having a door, a compressor at a lower portion of the main body, a low temperature storage part in the main body above the compressor and including several partitions for holding packed kimchis, a first motor at a bottom of each partition, a transportation plate operated by each motor, a cam which is linked to each transportation plate via an axis, a first limit switch located to one side of said cam for contact with said cam, a discharge plate installed at a bottom of the low temperature storage part, a second limit switch installed to be turned on when the discharge plate is opened to discharge a kimchi, a spring set up at an opposite side of the discharge plate, a second motor set up at one side of the discharge plate to return the discharge plate to an original position after discharge of a kimchi when the limit switch has been actuated, an evaporator and a fan installed in the main body over the low temperature storage part, and a money slot, selection buttons and an outlet equipped in the door.

2. A vending machine for kimchi according to claim 1, wherein the delivery arrangement includes:

A first motor at a bottom of each partition, a transportation plate operated by each motor, a cam which is linked to each transportation plate via an axis, and a first limit switch located to one side of said cam for contact with said cam.

3. A vending machine for kimchi according to claim 2, wherein the transportation plate includes a rotatable plate having a plurality of projections which are indexed by the motor to support a stack of kimchis in each partition.

4. A vending machine for kimchi according to claim 1, further comprising a control arrangement for the discharge plate, said control arrangement comprising:

a limit switch installed to be turned on when the discharge plate is opened to discharge a kimchi, a spring set up at an opposite side of the discharge plate, and a motor set up at one side of the discharge plate to return the discharge plate to an original position after discharge of a kimchi when the limit switch has been actuated.

5. A vending machine for kimchi comprising:

a main body having a door, a compressor at a lower portion of the main body, a low temperature storage part in the main body above the compressor and including several partitions for holding packed kimchis, a discharge plate installed at a bottom of the low temperature storage part, a delivery arrangement for supplying at least one kimchi from one of the partitions to the discharge plate, a money slot in the door for receiving money, at least one selection button in the door for selecting a kimchi to be supplied to the discharge plate, and an outlet equipped in the door for supplying a kimchi to a person from the discharge plate.

* * * * *